United States Patent [19]

Hook

[11] Patent Number: 4,509,510

[45] Date of Patent: Apr. 9, 1985

[54] MASSAGE TREAD FOR HUMAN SKIN

[76] Inventor: Clarence L. Hook, P.O. Box 4109, Bellevue, Wash. 98009

[21] Appl. No.: 439,649

[22] Filed: Nov. 5, 1982

Related U.S. Application Data

[63] Continuation-in-part of Ser. No. 334,741, Dec. 28, 1981, abandoned.

[51] Int. Cl.[3] ..... A61H 7/00; A43B 13/38; A47C 23/00

[52] U.S. Cl. ..... 128/25 R; 128/60; 156/292; 272/69; 36/44; 5/420; 428/120; 428/159; 264/242

[58] Field of Search ..... 272/96, 93, 70, 69, 272/109, DIG. 9; 128/25 B, 582, 62, 64, 56, 60, 581; 5/417, 347, 420, 448, 500, 481; 36/43, 44, 11.5, 28, 29; 297/453, 180; 428/419, 420; 264/242; 156/292, 210

[56] References Cited

U.S. PATENT DOCUMENTS

| | | | |
|---|---|---|---|
| 839,834 | 1/1907 | Gray | 5/420 X |
| 1,296,359 | 3/1919 | Brown | 5/420 |
| 2,465,725 | 3/1949 | Herzmark | 272/96 |
| 2,820,454 | 1/1958 | Wright | 272/96 X |
| 3,434,715 | 3/1969 | Bratingham | 272/96 |
| 3,681,797 | 8/1972 | Messner | 297/453 |
| 3,888,242 | 6/1975 | Harris | 128/25 B |
| 4,345,387 | 8/1982 | Daswick | 36/43 |

FOREIGN PATENT DOCUMENTS 921098 3/1963 United Kingdom .

*Primary Examiner*—Richard J. Johnson
*Attorney, Agent, or Firm*—Clinton L. Mathis

[57] ABSTRACT

A tread for surface contact with various surfaces of a human body, as feet, chest, abdomen, etc., has a base with upwardly projecting tines. A surface tread is provided in contact with, and is softer than, the tines. The relative hardness of the tines and the surface tread are designated. When the surface tread is urged toward the tines by a body portion urged against the surface tread, the tines, because of the relative hardness of the tines and the surface tread, will depress the surface portion and form dents or depressions therein. These depressions will mechanically resist side movement of the contacting tine portion and thus mechanically interlink the surface portion and the tines and thus the tines bend at midportion and with relatively little movement of the tip portions of the tines which is restrained because of the mechanical engagement with the tines and the depressions. The tines move with the pressure of a human body portion urged thereagainst and move in the opposite direction as the pressure is released or eased and thus, a massage action obtains in the skin portion of the body portion urged toward and relieved away from the surface tread.

12 Claims, 9 Drawing Figures

MASSAGE TREAD FOR HUMAN SKIN

APPLICATION STATUS

This application is a continuation-in-part of my copending application, Ser. No. 06/334/741, filed Dec. 28, 1981 now abandoned.

PERTINENT PRIOR ART

Since filing the above-mentioned prior application, applicant has had a search made as to the prior United States Letters Patent and he deems the following sufficiently pertinent to list the same herein, namely:

| U.S. PAT. NO. | PATENTEE | ISSUE DATE |
|---|---|---|
| 3,722,113 | Karl Birkenstock | March 27, 1973 |
| 3,757,774 | Kimio Hatuno | Sept. 29, 1973 |
| 2,356,808 | H. H. Allen | Aug. 29, 1944 |
| 4,095,353 | P. A. Foldes | June 20, 1978 |
| 3,859,727 | Hideru Nakamoto | Jan. 14, 1975 |
| 2,579,209 | W. G. Smith | Dec. 18, 1951 |

BACKGROUND OF THE INVENTION

This invention relates to a tread surface to be contacted by the skin of humans. The surface thereof may be that of treadmills, footpaths, tracks, running or walking surfaces, and mats which may be contacted by most any skin portion of a human body. It also may be incorporated in shoes to form the inner sole thereof.

The tread surface of this invention comprises a tread which will be deformed upon being depressed by the weight of a human body or human foot pressed thereon and the tread will react and result in massaging of the contacting human skin portion because of the weight and movement of the surface of the human body or foot being impressed on such tread surface. The massaging action is due to the nature and construction of the massage tread of my invention and such tread reacts to being depressed and moved by a human body portion and reacts to massage the contacting skin portion and the human skin portion will receive all of the health and pleasure benefits resulting from the massage action of my massage tread.

SUMMARY OF THE INVENTION

The tread of my invention may be contacted by human body portions pressed thereagainst and it may be used as a tread for walking or running surfaces over which a person treads in his bare or stockinged feet permitting the tread of my invention to be deformed by a contacting person's foot and the weight of such person. This tread surface is flexible and is connected, preferably mechanically, with upwardly projecting, flexible tines disposed therebelow. The relative hardness of such tread surface, or cover layer, to that of the tines is important in controlling the resulting massage action and the uses of devices of my invention. There are two results, the first being that as the tines are always harder than the tread surfaces, the upper end portions of the tines always form depressions in the tread surface and thus provide means for mechanically engaging the two. Second, the degree of relative hardness determines the degree of resistance to movement of the upper portions of the tines which are mechanically connected to the tread surface by the depressions mentioned. The action of the tines, and the relative depression and lateral movement of the individual members thereof will be controlled by the relative hardness of the tread or cover layer to that of the tines. Massage in one direction results from the depressing of the tread or cover layer by the weight and force of the body portion depressing the cover layer. Thereafter, the tread surface tends to return to its initial shape and form and in so doing, it massages in the other direction. Also, my device may be employed as the inner sole of a shoe and the bare or stockinged foot therein will cause the same action on such inner sole of the shoe and the inner sole of the shoe will have the same reaction resulting in the massaging of the foot of the wearer as the wearer walks or runs. Also, a person may lay or move some other body portion against the tread of my invention and the tread will react in a similar manner to massage the contacting body skin portion.

A particular object of my invention is to provide a tread surface for contact therewith by human feet treading thereon, whether it be a track, treadmill, running or walking surface, or the inner sole of a shoe. The tread of my invention comprises a base member having spaced apart, upwardly projecting, flexible tines. Over the upper surfaces of such flexible tines, a stretchable cover surface member is disposed. The relative hardnesses of the cover surface and the tines is such that when they are urged relatively toward each other, as when the tines are supported by a fixed object, as a floor, and a body portion urges the cover surface toward the upper portions of the tines, as when one steps on the cover portions, the cover layer is urged toward the top portions of the tines. The upper portions of the tines are somewhat mechanically interlocked with the cover layer because of depressions made therein by the tines and relative sidewise movement of the top portion of the tines is restrained because of the depressions resulting from the hardness of the cover being less than the hardness of the tines.

The flexible tines are formed of a plastic and the same may be artificial or natural rubber or combinations thereof. The hardness of the material forming such tines has a duromter reading in the range of 30 to 60 on the Shore A scale and preferably, the hardness is about 45. Each tine is preferably in the shape of a cone with a base diameter of about $\frac{1}{8}''$ and each terminates at its upper end portion in a half-spherical dome having a diameter of about 1/16".

The stretchable upper surface, or tread surface, is also formed of a plastic and the same also may be an artificial or natural rubber or combinations thereof. The hardness of the material forming such tread surface is much softer than that of the material forming the tines and, generally, material of this softness is registered on the Shore 00 scale to determine its hardness. When my device is used as a massage device for use on a person's body (with the exception of when a body is standing on my device), the hardness of the material of such tread surface is in the range of 25 to 45 hardness on the Shore 00 scale of durometer hardness. This normally would be considered soft. When the device is used by a person standing thereon, the hardness of the material should be in the range of 45 to 60 on the same scale. This would normally be considered medium. When the device is used as a fatigue rest (people merely standing thereon), the hardness of the material should be in the range of 60 to 80 on the same scale. This would normally be considered firm. Some fabrics have the desirable characteristics which may be used in fabricating the said upper surface.

Also, preferably, each of said tines has an elevation of one-half inch above the base member and the tines have a density of about 16 per square inch and each tine thereof has a length which is a plurality of times greater than its diameter.

BRIEF DESCRIPTION OF THE DRAWINGS

The various specified objects and advantages and others inherent therein will become explicit and implicit as the description of my invention proceeds in connection with the drawing thereof wherein like references refer to like parts and where.

DESCRIPTION OF A PREFERRED EMBODIMENT

The base member 10 and tines 12 are preferably molded as a single piece from any suitable plastic. The material may be natural rubber, synthetic rubber, combinations thereof or other moldable plastic which is stretchable and resilient. The durometer hardness of such material is in the range of 30 to 60 and, preferably, about 45, all on the Shore A scale. The tines 12 preferably project upwardly about one-half inch above the top surface of the base member 10. The bottom surface of the base member 10 may be plain or may be ridged (as shown) to provide the desired surface characteristics. Also, the tines 12 are preferably conical in shape and have a base diameter of about $\frac{1}{8}$" and each terminating in a half-spherical dome having a diameter of about 1/16 ".

Figure 1:
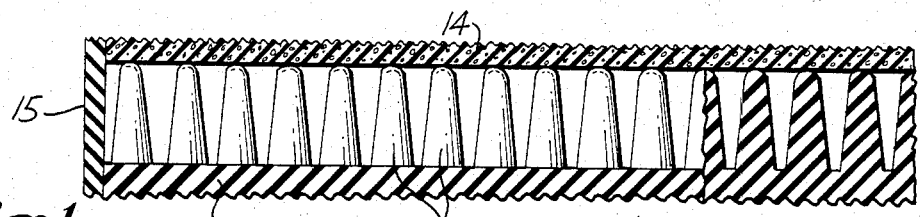
FIG. 1 is a fragmentary, sectional view of a tread surface embodying my invention, with parts in section.

A stretchable upper surface member 14 may be connected with, and form an airtight seal with, the base member 10, as by side walls 15 (one thereof being shown in FIG. 1). In some instances added advantages result by having tines 12 operate in a sealed airtight chamber. By adding the component of a sealed airtight chamber, economies in the size, shape, and hardnesses of the tines and their operation may be effected. This upper surface member is also formed of any suitable plastic, such as those mentioned above. The durometer hardness of such material is always softer than that of the tines 12 so that upon relative motion of the tines 12 toward the upper surface 14, concavities 13 will be formed, the depth of which are consistent with the amount of pressure indicated by the arrows 16.

Material of this softness is registered on the Shore 00 scale to determine its hardness. When my device is used as a massage device for use on a person's body (with the exception of when a body is standing on my device), the hardness of the material of such tread surface is in the range of 25 to 45 hardness. This normally would be considered soft. When the device is used by a person standing thereon, the hardness of the material should be in the range of 45 to 60 on the same scale. This would normally be considered medium. When the device is used as a fatigue rest (people merely standing thereon), the hardness of the material should be in the range of 60 to 80 on the same scale. This would normally be considered firm.

Figure 2:
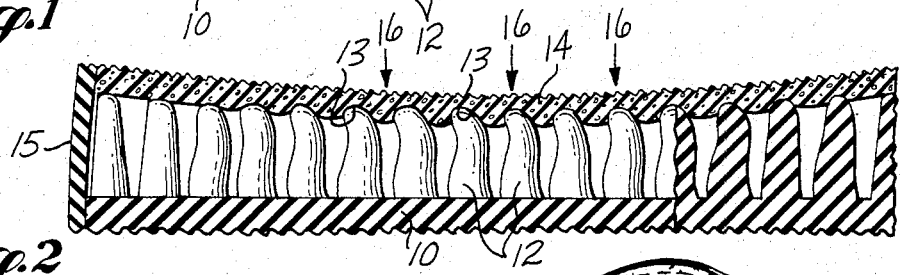
FIG. 2 is a similar view illustrating the reaction of the tread of my invention to a load impressed there against.

In FIG. 2, a portion of a human body (not shown) has been urged against the upper surface 14 providing a force illustrated by the arrows 16) causing the tines 12 to form concave recesses 13 in the upper surface member 14. This tends to provide mechanically engaged tines 12 in recess 13 in the upper surface 14. With such mechanical engagement, the tines 12 flex at mid portions in response to the force of arrows 16. The tines 12 are individually deformed and in various patterns depending upon the direction and extent that a portion of a human body is urged against the upper surface 14. The upper surface 14 stretches in response to such deformation of the tines 12 as it is secured to the upper portions of such tines through recesses 13. As the force, represented by the arrows 16, is relieved or varied, the longitudinal forces in the upper surface 14 are varied, and, in turn, such surface 14 moves in horizontal directions and massages the skin surface of the human skin portion. The extent of such horizontal force varies with the extent of the forces represented by the arrows 16. Thus, as the force represented by arrows 16 is undulated, a massaging or undulating action results against the skin, or lightly covering skin, portion which is being urged with varying pressure to provide the force represented by the arrows 16.

Figure 3:
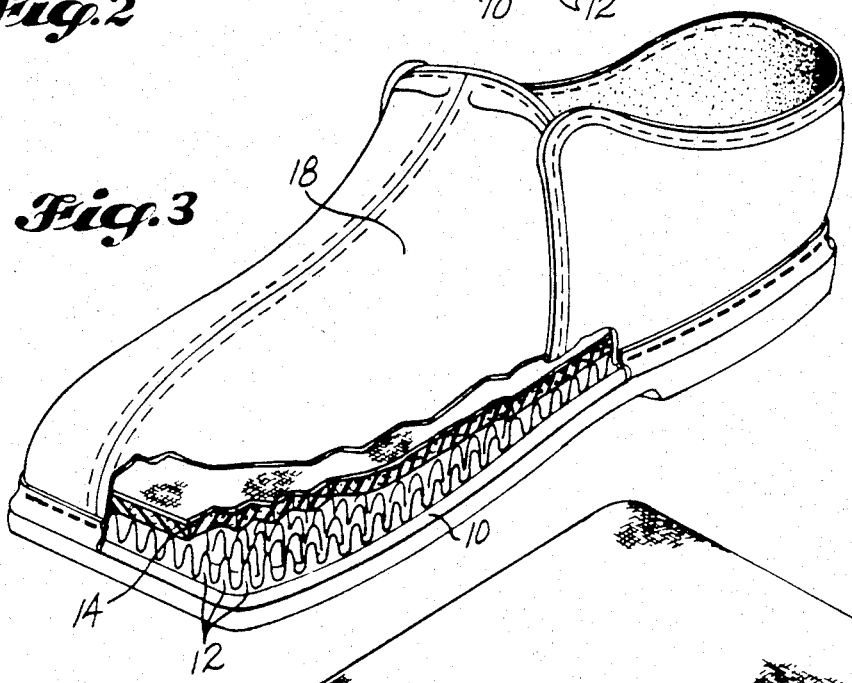
FIG. 3 is a perspective view of a shoe, with parts broken away, showing my invention applied as the inner sole of the shoe.

In FIG. 3, the tread surface of my invention (shown per se in FIG. 1) is shown at the inner sole of a shoe 18. Here the shoe 18 has the inner sole of my invention and the parts thereof bear the same number as similar parts in FIGS. 1 and 2. The shoe 18 is merely illustrative of a shoe and is not a limitation as my invention can be applied as the inner sole of any appropriate shoe.

In using the tread of my invention as the inner sole of a shoe, the wearer should be bare- or stocking-footed so that the wearer's foot can be reacted by the tread and thus the foot of the person is massaged. The user may run fast or slow or walk and the massaging benefits will result and to an extent commensurate with the frequency of the impact and the strength thereof.

Figure 4:
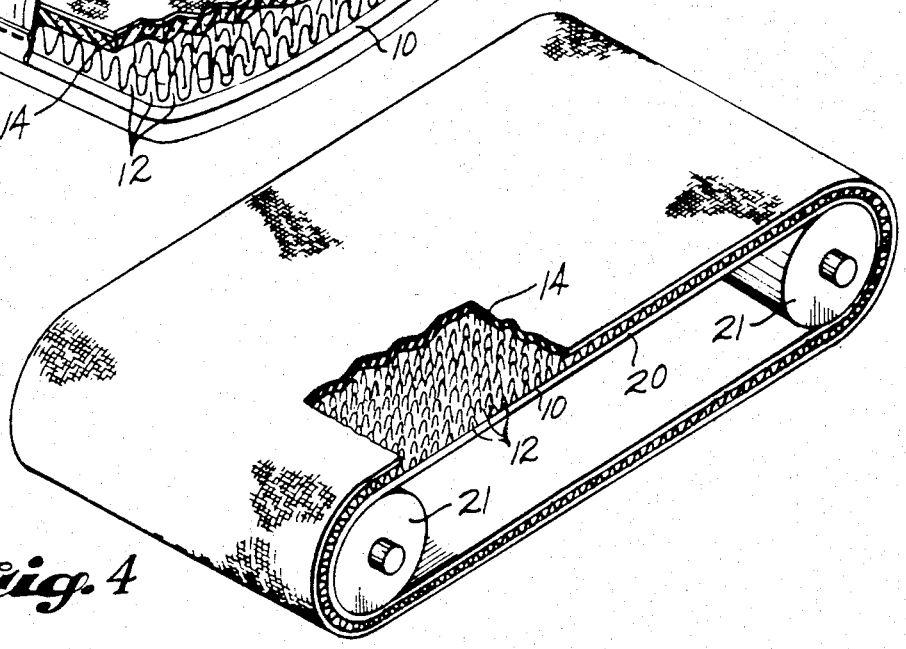
FIG. 4 is a perspective fragmentary view of an endless treadmill with the tread thereof embodying my invention.

In FIG. 4, my invention has been illustrated as the endless tread 20 of a treadmill having two supporting rolls 21, one of which is driven during appropriate travel direction of tread 20. The various portions of the tread and their functions are incorporated by reference and with the same numbers. Also, the human skin reaction after contact with the tread will be the same as in the previous figures.

Figure 5:
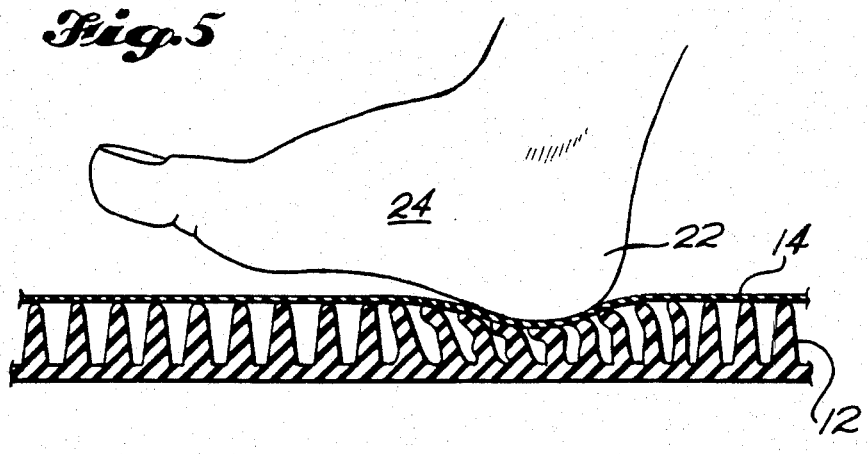
FIG. 5 is a perspective view of a person's bare foot with the bottom heel portion of the foot engaging a mat of my invention.
Figure 6:
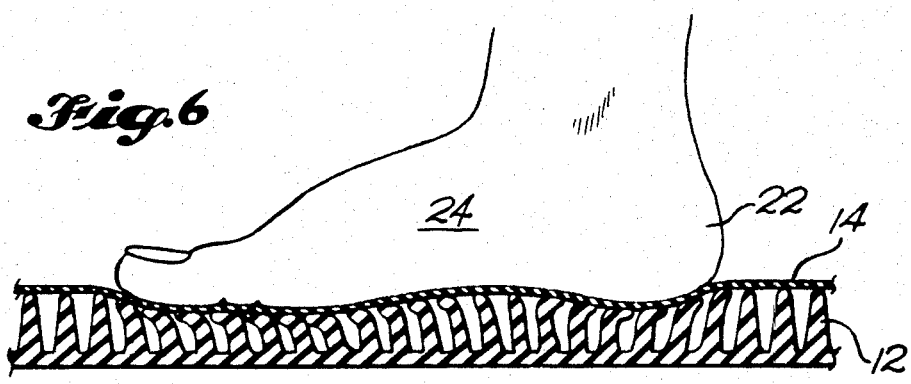
FIG. 6 is a similar view as FIG. 5 but with the entire bottom portion of the foot so engaged.

In FIG. 5 of the drawings, the foot 24 of a person starting to walk on a mat of my invention is illustrated. The heel 22 has distorted some of the tines 12. As the foot 24 walks in the person going forward, the position of some of the tines 12 has changed as illustrated in FIG.

Figure 7:
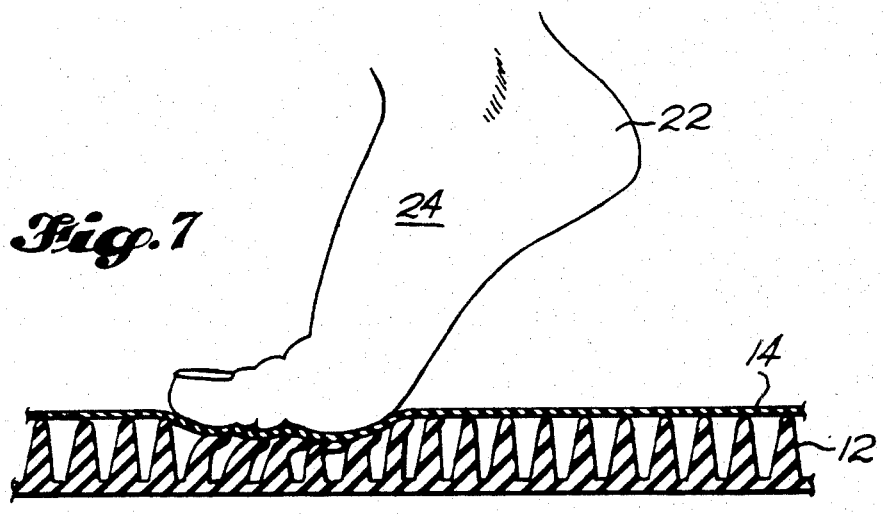
FIG. 7 is another view similar to FIGS. 5 and 6 but with only the ball of the foot engaging.

6. This movement of the tines is reflected in the movement of the upper surface member 14 and the movement of the surface member 14 is reflected in movement thereof against the bar foot 24. Further movement of the person having a foot 24 is shown in FIG. 7 where the weight of the person is now on the ball 26 of the foot 24. Again, there are different movements of the tines 12 involved and in the upper surface 14 contacting the bottom of the foot 24. The foregoing illustrates the actions and reactions involved in walking or treading on a mat embodying my invention.

Figure 8:
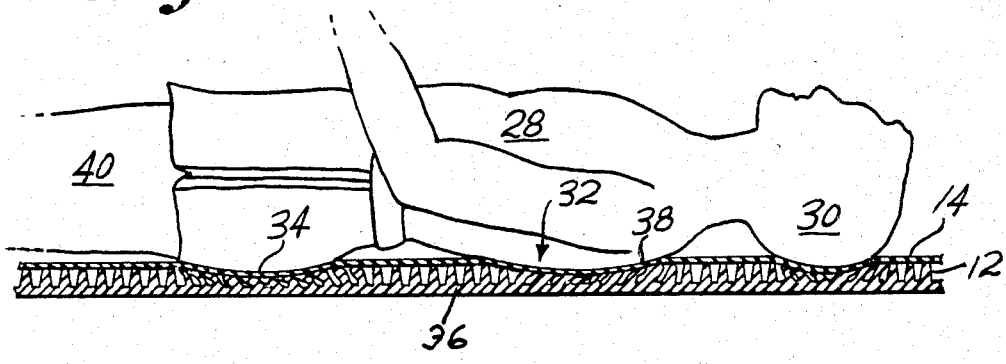
FIG. 8 is a fragmentary perspective view of a person lying supine on a mat of my invention.
Figure 9:
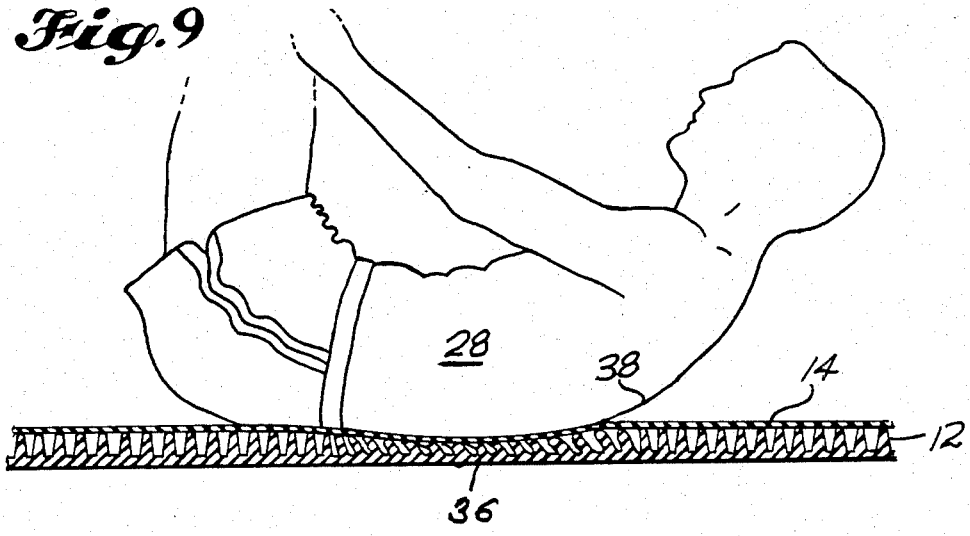
FIG. 9 shows the person of FIG. 8 after his head and legs have been raised and parts of his back are still on the mat of my invention.

In FIG. 8, a person is illustrated as lying supine on a mat of my invention. Here the person has his head 30, back 32, and buttocks 34 engaging the mat 36 of my invention. The tines 12 and upper surface 14 are distorted and their changes are again reflected in stretching movements of the upper surface 14 and also in the skin of the person 28 engaging such upper surface 14. When the person 28 raises his head 30, shoulders 38, and legs 40, again we have movement of some of the tines 12, upper surface 14, and contacting skin portion of the person involved.

Thus, regardless of the skin portions, or lightly clothed skin portions, of a person engaging the tread of my invention, there will be a reaction of the skin portion so engaging and the upper surface 14 providing the desired massaging, invigorating, and highly pleasant action by mats of my invention.

RESUMÉ

There is provided a tread for surface contact by human feet, the skin of various human body portions, such as bare feet, chest, back, abdomen, etc. This tread comprises a base 10 and upwardly projecting tines 12, preferably formed of a single piece. The material used in forming said base 10 and tines 12 is a plastic and the same may be formed of natural or synthetic rubbers or other suitable rubbers having desired resiliency and elasticity. The hardness of the material forming the base member 10 and the tines 12 has a durometer reading of hardness on the Shore A scale in the range of 30 to 60 and, preferably, about 45.

The stretchable upper surface, or tread surface, is also preferably formed of a plastic and the same also may be an artificial or natural rubber or combination thereof. Also, some fabrics may be used in such upper surface if they have the appropriate softness and abilities. The hardness of the material forming such tread surface is much softer than that of the material forming the tines and, generally, material of this softness is registered on the Shore 00 scale to determine its hardness. When my device is used as a massage device on a person's body (with the exception of when a body is standing on my device), the hardness of the material of such tread surface is in the range of 25 to 45 hardness on the Shore 00 scale of durometer hardness. This normally would be considered soft. When the device is used by a person standing thereon, the hardness of the material should be in the range of 45 to 60 on the same scale. This would normally be considered medium. When the device is used as a fatigue rest (people merely standing thereon), the hardness of the material should be in the range of 60 to 80 on the same scale. This would normally be considered firm.

The tines 12 have a height of about one-half inch and the tines have a density of about 16 per square inch. The tines are preferably conical shape and have a base diameter of about $\frac{1}{8}$" and each terminating in a half-spherical dome having a diameter of about 1/16". The upper portions of the tines are mechanically linked with the upper surface 14 through engagement with the walls of depressions 13 in the upper surface 14. Also, in some instances, the base 10 is in sealed connection with the upper surface 14, as by walls 15, and thus the tines 12 operate in an airtight chamber and the tine operation is modified thereby. The upper surface 14 is connected with the marginal tines 12 to maintain them as a unit. The tread of my invention may be used in connection with various running and walking tracks, treadmills, mats, or as the inner soles of shoes.

Due to the fact that the tines 12 are always harder than the upper surface 14, when any body weight is urged against the upper side of surface member 14, the tines 14 will be relatively urged into the lower side of surface member 14 and cause depressions 13 therein. These depressions 13 and the upper end portions of the tines 12 will thus be relatively mechanically interlocked and the upper end portions of the tines 12 will not slide relative to the surface member 14. The tines 12 will bend at mid portions thereof in reacting against body pressure exerted against the upper side of surface member 14 and hence, to the tines 12. This interaction between the upper surface member 14 and the tines 12 is most important in the exercise of my invention.

Obviously, changes may be made in the forms, dimensions and arrangements of the parts of my invention without departing from the principle thereof, the above setting forth only perferred forms of embodiment of my invention.

I claim:

1. A surface for contact by human skin intermittently urged thereagainst, comprising a base member having spaced apart, upwardly projecting, flexible tines, each of said tines having a height a plurality of times greater than its diameter; and an upper surface member having a lesser hardness than said tines, disposed above and being provided with depressions therein when the upper surface of said tines are relatively urged thereagainst, and being mechanically engaged with the said tines through said depressions and the upper portions of said tines urged into said depressions, said tread surfaces reacting to massage human skin portions urged toward such upper surface.

2. The combination of claim 1, wherein the flexible tines are formed of a plastic having a hardness on the Shore A scale in the range of 30 to 60.

3. The combination of claim 1, wherein the flexible tines are formed of a plastic having a hardness on the Shore A scale of about 45.

4. The combination of claim 1, wherein the upper surface is formed of a plastic having a hardness on the Shore 00 scale of 25 to 45.

5. The combination of claim 1, wherein the upper surface is formed of a plastic having a hardness on the Shore 00 scale of 45 to 60.

6. The combination of claim 1, wherein the upper surface is formed of a plastic having a hardness on the Shore 00 scale of 60 to 80.

7. The combination of claim 1, wherein each of said tines has an elevation of about $\frac{1}{2}$ inch.

8. The combination of claim 1, wherein said tines have a density of about 16 per square inch.

9. The combination of claim 1, wherein said surface comprises the tread of an endless treadmill.

10. A surface for contact by human skin intermittently urged thereagainst, comprising a base member in the form of an inner sole of a shoe having spaced apart, upwardly projecting, flexible tines; and an upper surface member having a lesser hardness than said tines, disposed above and being provided with depressions therein when the upper surface of said tines are relatively urged thereagainst, and being mechanically engaged with the said tines through said depressions and the upper portions of said tines urged into said depressions, and tread surfaces reacting to massage human skin portions urged toward such upper surface.

11. A surface for contact by human skin intermittently urged thereagainst, comprising a base member having spaced apart, upwardly projecting, flexible tines, each of said tines having a base diameter of about $\frac{1}{8}''$ and terminating in a half-sperical dome having a diameter of 1/16"; and the upper surface member having a lesser hardness than said tines, disposed above and being provided with depressions therein when the upper surface of said tines are relatively urged thereagainst, and being mechanically engaged with the said tines through said depressions and the upper portions of said tines urged into said depressions, and tread surfaces reacting to massage human skin portions urged toward such upper surface.

12. A surface for contact by human skin intermittently urged thereagainst, comprising a base member having spaced apart, upwardly projecting, flexible tines; and an upper surface member having a lesser hardness than said tines, disposed above and being provided with depressions therein when the upper surface of said tines are relatively urged thereagainst, and being mechanically engaged with the said tines through said depressions and the upper portions of said tines urged into said depressions, said tread surfaces reacting to message human skin portions urged toward such upper surface, said based member being provided with an airtight connection with the upper surface member providing an airtight chamber in which the tines function.

* * * * *